US011976491B2

(12) United States Patent
Carrasco et al.

(10) Patent No.: US 11,976,491 B2
(45) Date of Patent: May 7, 2024

(54) HEAT PUMP POOL WATER HEATER SYSTEMS AND METHODS THERETO

(71) Applicant: Rheem Manufacturing Company, Atlanta, GA (US)

(72) Inventors: Hiram Osuna Carrasco, Oxnard, CA (US); Jorge Miguel Gamboa Revilla, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 160 days.

(21) Appl. No.: 17/506,871

(22) Filed: Oct. 21, 2021

(65) Prior Publication Data

US 2023/0127276 A1 Apr. 27, 2023

(51) Int. Cl.
*E04H 4/12* (2006.01)
*F24H 9/20* (2022.01)

(52) U.S. Cl.
CPC ..... *E04H 4/129* (2013.01); *F24H 9/2007* (2013.01)

(58) Field of Classification Search
CPC ..... E04H 4/129; F24H 15/196
See application file for complete search history.

(56) References Cited

U.S. PATENT DOCUMENTS

2007/0079436 A1* 4/2007 Na ..... A61H 33/60 4/541.1
2007/0233420 A1* 10/2007 Potucek ..... G05D 23/1902 702/130
2009/0204263 A1* 8/2009 Love ..... G05D 23/19 700/282
2020/0319621 A1* 10/2020 Roy ..... G01R 19/16571
2020/0333813 A1* 10/2020 Goldman ..... G05D 23/1917
2021/0190372 A1* 6/2021 Montanez ..... F24H 15/31
2022/0163221 A1* 5/2022 Vega ..... F24H 1/202

FOREIGN PATENT DOCUMENTS

CN 107543896 A 1/2018
DE 10 2011 103317 A1 11/2012
WO 2012051276 A1 4/2012

OTHER PUBLICATIONS

International Search Report and the Written Opinion of International Application No. PCT/US2022/044527 dated Jan. 17, 2023.

* cited by examiner

*Primary Examiner* — J C Jacyna
(74) *Attorney, Agent, or Firm* — Eversheds Sutherland (US) LLP

(57) ABSTRACT

The disclosed technology includes systems and methods for operating a pool water heating system. The pool water heating system can include a heat pump, a supplemental heat source, a water temperature sensor, and a controller. The controller can be configured to receive water temperature data and, in response to determining that the temperature of the water is less than a threshold temperature, output a control signal to activate the heat pump. The controller can further determine an expected heating time that can be indicative of an amount of time required for the temperature of the water to be greater than or equal to the threshold temperature. The controller can also generate a heating schedule based at least in part on the expected heat time and a predetermined time of use. The heating schedule can be indicative of a heat pump operation time and a supplemental heat source operation time.

16 Claims, 3 Drawing Sheets

HEAT PUMP POOL WATER HEATER SYSTEMS AND METHODS THERETO

FIELD OF TECHNOLOGY

The disclosed technology relates generally to systems and methods for pool water heaters and, more particularly, to heat pump pool water heaters.

BACKGROUND

Commercial and residential pools are commonly heated using a pool water heater to maintain the temperature of the water within a comfortable temperature range. Pool water heaters typically consist of gas water heaters, electric water heaters, or heat pump pool heaters (HPPHs). Although gas water heaters and electric water heaters are capable of heating water quickly, they typically consume a considerable amount of energy to heat the water. HPPHs, on the other hand, are generally more energy efficient than gas and electric water heaters but can require longer heating times to bring a temperature of the pool water to a desired temperature. For example, some gas or electric pool water heaters can raise the temperature of the water in a pool to a desired temperature within a matter of hours while some HPPHs can require several days to reach the same temperature.

Local weather conditions can also significantly impact the pool heat-up time, especially when using an HPPH. For example, in cool ambient weather conditions, heat added to the water by the HPPH can be lost to the cooler ambient air. Because heat is lost to the ambient air, the time required to heat the pool is elongated. Furthermore, changing weather conditions can have a significant impact on the time required to heat the pool using an HPPH because the ambient temperature and humidity impact the heat pump's ability to heat the water. Thus, the combination of the heat lost from the pool water to the ambient air and the heat pump being unable to operate efficiently can cause the HPPH to require additional time to heat the pool water to a desired temperature or, in extreme situations, can altogether render the HPPH unable to heat the pool water to the desired temperature.

To help ensure the pool water is able to be heated to a desirable temperature, even in cool weather, some pool heating systems include a supplemental water heating system in addition to the HPPH. For example, some pool water heating systems may have both an HPPH and a gas water heater. As another example, some systems may have an HPPH, a solar thermal water heater, and an electric water heater. No matter the combination of types of water heaters, existing pool water heating systems are typically programmed to default to the HPPH unless the HPPH is unable to sufficiently heat the water. For example, existing pool water heater systems can default to utilizing an HPPH unless the HPPH is able to sufficiently heat the pool water, in which case, the gas water heater will be utilized. This control arrangement, however, is unable to efficiently account for changes in weather conditions. For example, it may be most energy efficient on sunny days to heat the pool with only the solar thermal water heater, it may be most energy efficient on warm, cloudy days to operate the HPPH, and it may be most energy efficient on cool days or during nights to operate only the gas water heater.

To further complicate matters, use of the pool may vary depending on the user's schedule. For example, the pool may be used only on nights and weekends, used most frequently in the mornings, or used sporadically. In each situation, it is often wasteful to continue heating the pool when the pool is not in use. Therefore what is needed is a pool water heater control system that can account for varying use of the pool, changing weather conditions, and the impact the performance of the HPPH will have on the pool water heat-up time to ensure the pool water is adequately heated by the time a pool is intended to be used.

SUMMARY

These and other problems are addressed by the technology disclosed herein. The disclosed technology relates generally to systems and methods for pool water heaters and, more particularly, to heat pump pool water heaters. The disclosed technology includes a pool water heating system comprising a heat pump configured to provide heat to a volume of water, a supplemental heat source configured to provide heat to the volume of water, and a water temperature sensor configured to detect a temperature of the volume of water and output water temperature data indicative of the temperature of the volume of water. The pool water heating system can further include a controller configured to receive the water temperature data from the water temperature sensor. In response to determining, based at least in part on the water temperature data, that the temperature of the water is less than a threshold temperature, the controller can be configured to output a control signal to activate the heat pump to heat the water. The controller can be configured to determine an expected heating time based at least in part on a heat output of the heat pump, the temperature data, and the threshold temperature. The expected heating time can be indicative of an amount of time required for the heat pump to increase the temperature of the volume of water to a temperature greater than or equal to the threshold temperature. The controller can be further configured to generate a heating schedule based at least in part on the expected heat time and a predetermined time of use, the heating schedule being indicative of a heat pump operation time and a supplemental heat source operation time.

The controller can be further configured to receive, from a remote server, weather data indicative of a forecast of local weather. Furthermore, determining the expected heating time can be further based at least in part on the weather data.

Generating the heating schedule can include determining the heat pump operation time and the supplemental heat source operation time based at least in part on the expected heating time, the weather data, and supplemental heat source data. The supplemental heat source data can be indicative of a type of supplemental heat source available. The heat pump operation time can be a scheduled time to operate the heat pump and the supplemental heat source operation time can be a scheduled time to operate the supplemental heat source.

The supplemental heat source can be a gas water heater, an electric water heater, a solar thermal water heater.

The controller can be further configured to calculate the heat output of the heat pump based at least in part on heat pump data. The heat pump data can be indicative of at least a type of compressor and a type of refrigerant of the heat pump.

The controller can be configured to receive, from a remote server, weather data indicative of a forecast of local weather and calculate, based at least in part on the weather data, the heat output of the heat pump.

The pool water heating system can further include a humidity sensor that can be configured to detect a humidity level of ambient air proximate the heat pump and output humidity data. The pool water heating system can further include an air temperature sensor that can be configured to detect a temperature of the ambient air proximate the heat pump and output air temperature data. The controller can be further configured to receive the humidity data from the humidity sensor, receive the air temperature data from the air temperature sensor, and calculate, based at least in part on the humidity data and the air temperature data, the heat output of the heat pump.

The pool water heating system can further include a refrigerant temperature sensor that can be configured to detect a refrigerant temperature of the heat pump and output refrigerant temperature data. The controller can be further configured to receive the refrigerant temperature data from the refrigerant temperature sensor and calculate, based at least in part on the refrigerant temperature data, the heat output of the heat pump.

The pool water heating system can further include a current sensor configured to detect an electrical current supplied to the heat pump and output current sensor data. The controller can be further configured to receive the current sensor data from the current sensor and calculate, based at least in part on the current sensor data, the heat output of the heat pump.

The controller can be further configured to calculate, based at least in part on the water temperature data over a period of time, the current heat output of the heat pump.

The controller can be further configured to determine, based at least in part on a type of compressor of the heat pump, an expected heat output of the heat pump. In response to determining that the current heat output of the heat pump is less than the expected heat output of the heat pump, the controller can be configured to output a notification to a user interface. The notification can be indicative of the heat pump operating at a degraded performance.

In response to determining that the current heat output of the heat pump is less than the expected heat output of the heat pump, the controller can be further configured to output, to a remote server, a request to schedule maintenance for the heat pump. The predetermined time of use can be received from a user interface in communication with the controller. The user interface can be a mobile device.

The disclosed technology includes a method of operating a pool water heating system. The method can include receiving water temperature data from a water temperature sensor of the pool water heating system. In response to determining, based at least in part on the water temperature data, that a temperature of water is less than a threshold temperature, the method can include outputting a control signal to activate a heat pump of the pool water heating system to heat the water. The method can further include determining an expected heating time based at least in part on a heat output of the heat pump, the temperature data, and the threshold temperature. The expected heating time can be indicative of an amount of time required for the temperature of the water to be heated greater than or equal to the threshold temperature. The method can further include generating a heating schedule based at least in part on the expected heat time and a predetermined time of use. The heating schedule can be indicative of a heat pump operation time and a supplemental heat source operation time.

The method can include receiving, from a remote server, weather data indicative of a forecast of local weather and determining the expected heating time based at least in part on the weather data.

Generating the heating schedule can include determining the heat pump operation time and the supplemental heat source operation time based at least in part on the expected heating time, the weather data, and supplemental heat source data. The supplemental heat source data can be indicative of a type of supplemental heat source available. The heat pump operation time can include a scheduled time to operate the heat pump and the supplemental heat source operation time can include a scheduled time to operate the supplemental heat source.

The method can include calculating, based at least in part on the water temperature data over a period of time, the heat output of the heat pump.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
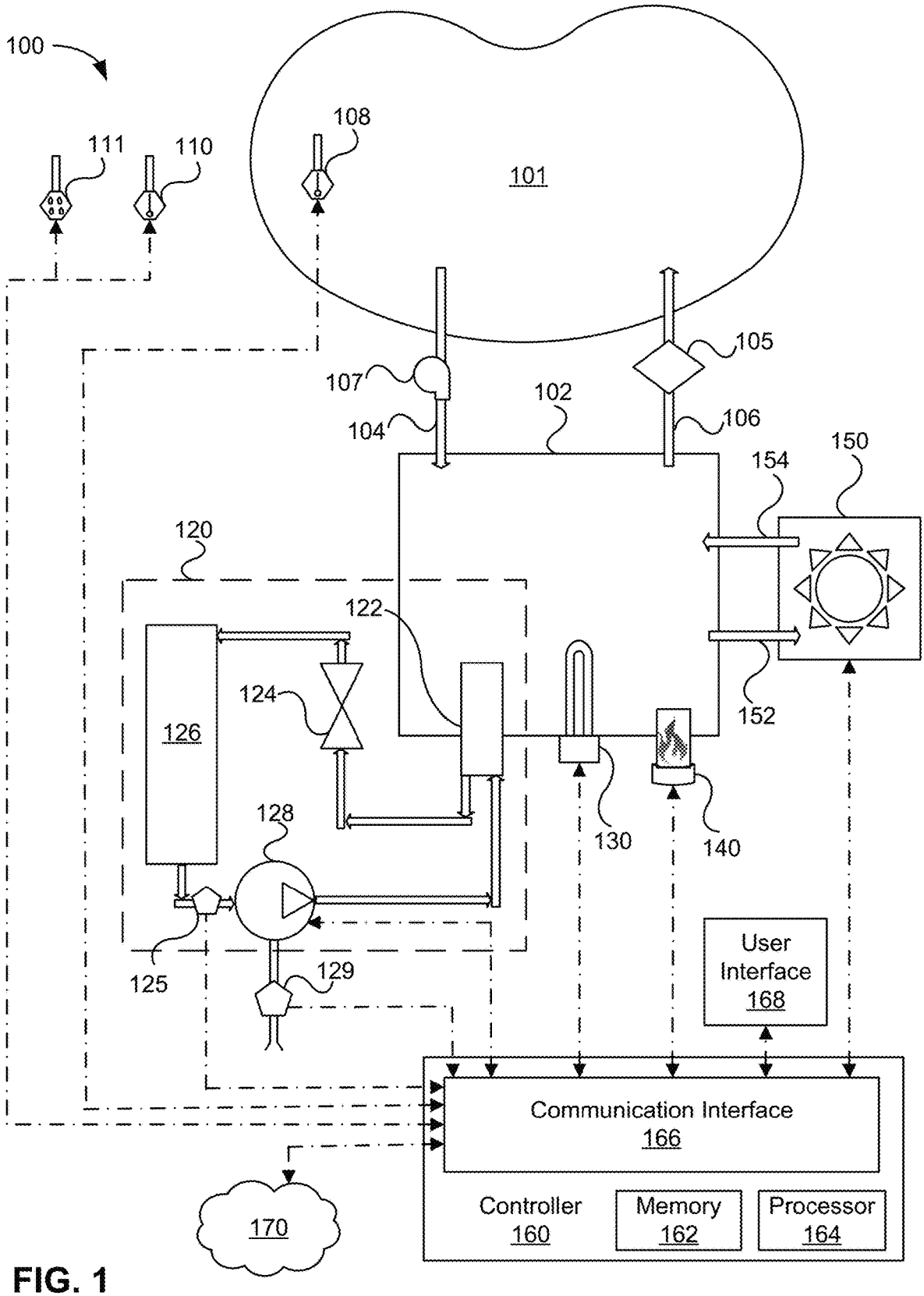
FIG. 1 illustrates an example heat pump pool water heating system, in accordance with the disclosed technology.

The disclosed technology relates generally to systems and methods for pool water heaters and, more particularly, to heat pump pool water heaters. The pool water heating system can include a heat pump pool heater (HPPH) and a supplemental water heater that can each be configured to heat pool water. The supplemental water heater can be, for example, a gas water heater, an electric water heater, a solar thermal water heater, or any other suitable type of water heater for the application (e.g., any non-heat-pump water heater). The pool water heating system can include a controller that can control the HPPH and the supplemental water heater to efficiently heat the pool water. For example, the controller can receive weather data (e.g., temperature data, humidity data, etc.) and water temperature data and determine an amount of time it will take to heat the pool water. The controller can receive the weather data either from sensors that are part of, or in communication with, the pool water heating system or from a remote server. The controller can also generate a heating schedule that determines which water heater (i.e., HPPH or a supplemental water heater) to operate at given times to ensure the pool water is sufficiently heated by the time a user desires to use the pool while increasing and/or maximizing efficiency of the overall pool heating system. Additionally, the controller can determine a current performance of the heat pump and/or output an alert to a user or schedule maintenance to have the heat pump repaired.

Although certain examples of the disclosed technology are explained in detail herein, it is to be understood that other examples, embodiments, and implementations of the disclosed technology are contemplated. Accordingly, it is not intended that the disclosed technology is limited in its scope to the details of construction and arrangement of components expressly set forth in the following description or illustrated in the drawings. The disclosed technology can be implemented in a variety of examples and can be practiced or carried out in various ways. In particular, the presently disclosed subject matter is described in the context of being a pool water heater system. The present disclosure, however, is not so limited, and can be applicable in other contexts. The present disclosure, for example and not limitation, can include other water heater systems such as boilers, industrial fluid heaters, process control systems, and other water heater systems configured to heat water where more than one heat source is available to heat the fluid in the system. Furthermore, the present disclosure can include other fluid heating systems configured to heat a fluid other than water such as process fluid heaters used in industrial applications. Such implementations and applications are contemplated within the scope of the present disclosure. Accordingly, when the present disclosure is described in the context of being a system and method for heating pool water, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the examples, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the various examples of the disclosed technology includes from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the example methods and processes described herein. That is, the disclosed technology includes methods that omit one or more steps expressly discussed with respect to the examples provided herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

Although the term "water" is used throughout this specification, it is to be understood that other fluids may take the place of the term "water" as used herein. Therefore, although described as a water heater system, it is to be understood that the system and methods described herein can apply to fluids other than water. Further, it is also to be understood that the term "water" can replace the term "fluid" as used herein unless the context clearly dictates otherwise.

Referring now to the drawings, in which like numerals represent like elements, examples of the present disclosure are herein described. FIG. 1 illustrates an example pool water heating system 100, in accordance with the disclosed technology. To facilitate an understanding of the pool water heating system 100, the various components of the pool water heating system 100 are first described and then various examples of operating the pool water heating system 100 are described. While the disclosed technology can be used to heat various liquids and/or solutions, discussion of the disclosed technology is limited to its use with water.

The pool water heating system 100 can include a pool 101 and a heating chamber 102 having a fluid inlet 104 and a fluid outlet 106. The fluid inlet 104 and the fluid outlet 106 can be in fluid connection with the pool 101 to allow for circulation of the water from the pool 101 to the heating chamber 102. The water can be circulated between the pool 101 and the heating chamber 102 by a pump 107. Although illustrated as being installed on or proximate the inlet 104, the pump 107 can be in any location so long as the pump 107 can circulate the water between the pool 101 and the heating chamber 102. Alternatively, or in addition, the water can be circulated between the pool 101 and the heating chamber 102 by natural convection created when heating the water.

The pool water heating system 100 can include various water heating systems such as a heat pump pool heater (HPPH) 120, an electric water heater 130, a gas water heater 140, and/or a solar thermal water heater 150. The pool water heating system 100 can be configured to primarily operate the HPPH 120, and the other water heating systems (i.e., the electric water heater 130, the gas water heater system 140, and/or the solar thermal water heater 150) can be utilized as supplemental heat sources. For example, as will be described in greater detail herein, the pool water heating system 100 can include a controller 160 that can be configured to operate the HPPH 120 and utilize a supplemental heat source (i.e., the electric water heater 130, the gas water heater system 140, and/or the solar thermal water heater 150) when the HPPH 120 is unable to meet the heat demand or would not be the most efficient heat source to heat the pool water.

The heating chamber 102 can simply be any location where water circulated from the pool 101 is heated. For example, the heating chamber 102 can be or include a heat exchanger or simply a pipe or tube with the various heat sources being capable of heating the water as it is passed from the pool 101 and through the heating chamber 102. The heating chamber 102 can be sized for various applications. For example, the heating chamber 102 can be sized for common residential uses or for commercial or industrial uses that require greater amounts of heated water. Furthermore, the heating chamber 102 can be made of any suitable material for heating water, including copper, carbon steel, stainless steel, ceramics, polymers, composites, or any other suitable material. The heating chamber 102 can be treated or lined with a coating to prevent corrosion and leakage. A suitable treating or coating can be capable of withstanding the temperature and pressure of the system and can include, as non-limiting examples, glass enameling, galvanizing, thermosetting resin-bonded lining materials, thermoplastic coating materials, cement coating, or any other suitable treating or coating for the application. Optionally, the heating chamber 102 can be insulated to retain heat. For example, the heating chamber 102 can also be insulated using fiberglass, aluminum foil, organic material, or any other suitable insulation material.

The pool water heating system 100 can include at least one flow sensor 105 that can be configured to calculate a flow of water being passed through the heating chamber 102. As will be appreciated by one of skill in the art, flow data supplied by the flow sensor 105 can be used to determine a volumetric flow rate of the water passing through the heating chamber 102 which can be used to calculate a rate at which the water in the pool 101 is being heated. Furthermore, by calculating the rate at which the water in the pool 101 is being heated, the controller 160 (as described herein) can be configured to calculate a current output of the HPPH 120 and determine a current operating efficiency of the HPPH 120.

Although the flow sensor 105 is illustrated as being installed downstream of the heating chamber 102, one of skill in the art will appreciate that the flow sensor 105 can be installed in any suitable location so long as the flow sensor 105 can detect a flow of at least a portion of the water flowing through the heating chamber 102. For example, the flow sensor 105 can be installed upstream of the heating chamber 102, inside of the heating chamber, or even in the pool 101. Furthermore, the flow sensor 105 can be any suitable type of flow sensor for the application. For example, the flow sensor 105 can be an ultrasonic sensor, a venturi sensor, an orifice plate sensor, a rotameter sensor, a Coriolis sensor, an electro magnetic sensor, or any other suitable type of flow sensor or flow meter.

The pool water heating system 100 can have at least one water temperature sensor 108 configured to detect a temperature of the water in the pool 101 or otherwise in the pool water heating system 100. The water temperature sensor 108 can be located or positioned to detect a temperature of the water in the system at various locations such as in the pool 101, upstream of the heating chamber 102, inside of the heating chamber 102, downstream of the heating chamber 102, or any other suitable location in the system 100 where the temperature of the water can be detected. The water temperature sensor 108 can each be configured to output temperature data and be in communication with a controller 160. As will be described in greater detail herein, the temperature data provided by the water temperature sensor 108 can be used by the controller 160 to determine actions based on current system conditions.

The pool water heating system 100 can include an ambient temperature sensor 110 configured to detect a temperature of the ambient air proximate the pool water heating system 100 and output temperature data to the controller 160. As will be appreciated, the ambient temperature sensor 110 can be installed in various locations proximate the pool water heating system 100 such that the ambient temperature sensor 110 can detect and/or measure a temperature of the ambient air proximate the pool water heating system 100 and output data corresponding to the detected temperature of the ambient air. For example, the ambient temperature sensor 110 can be mounted on or in the pool water heating system 100, or the ambient temperature sensor 110 can be placed in another location (e.g., near the pool water heating system 100).

The water temperature sensor 108 and the ambient temperature sensor can be any type of temperature sensor capable of measuring the temperature of a fluid (e.g., water in the pool water heating system 100, ambient air proximate the pool water heating system 100) and providing temperature data indicative of the fluid temperature to the controller 160. For example, the water temperature sensor 108 and the ambient temperature sensor 110 can be thermocouples, resistor temperature detectors, thermistors, infrared sensors, semiconductors, or any other type of sensor which would be appropriate for a given use or application. All temperature sensors of the system can be the same type of temperature sensor, or the system 100 can include different types of temperature sensors. For example, water temperature sensor 108 can be a thermocouple, while the ambient temperature sensor 110 can be a thermistor or vice versa. One skilled in the art will appreciate that the type, location, and number of temperature sensors can vary depending on the application.

The pool water heating system 100 can include a humidity sensor 111 that can be configured to detect a humidity level of the ambient air proximate the pool water heating system 100. The humidity sensor 111, sometimes referred to as a hygrometer, can be any type of humidity sensor configured to detect a humidity level (or level of water vapor) in the ambient air and output humidity data. For example, the humidity sensor 111 can be a capacitive, resistive, thermal, gravimetric, optical, or any other suitable type of humidity sensor for the application. The humidity sensor 111 can be configured to measure absolute humidity, relative humidity, or specific humidity and can send digital or analog signals to the controller 160.

As illustrated in FIG. 1, the disclosed technology can include a HPPH 120 to heat the fluid in the heating chamber 102. The HPPH 120 can be any suitable form of heat pump that can be used to heat water, including compression- or absorption-type heat pumps. The HPPH 120 can be adapted to use an air source, ground source, water source, or any other heat source. The HPPH 120 can also be a geothermal, air-to-water, water-to-water, liquid-to-water, or any other type of heat pump system that is appropriate for the particular application. As an example, the HPPH 120 can be an air source type heat pump, which utilizes a refrigerant in a vapor-compression cycle, but the type of heat source can be modified depending on the particular application. The HPPH 120 can be a single-stage, two-stage, or variable capacity heat pump, depending on the application. Furthermore, one or more components of the HPPH 120 can be in communication with the controller 160. For example, the expansion valve 124 and the compressor 128 can each be configured to receive control signals from, or otherwise be operated by, the controller 160.

The HPPH 120 can include a condenser 122, an expansion valve 124, an evaporator 126, and a compressor 128. The various components can be sized, shaped, and located as would be suitable for the particular application. As will be appreciated, the various components of the HPPH 120 can be sized for residential, commercial, or industrial applications and for heating water within various temperature ranges and within various time ranges.

The compressor 128 can be any type of compressor. For example, the compressor 128 can be a positive displacement compressor, a reciprocating compressor, a rotary screw compressor, a rotary vane compressor, a rolling piston compressor, a scroll compressor, an inverter compressor, a diaphragm compressor, a dynamic compressor, an axial compressor, or any other form of compressor that can be integrated into the HPPH 120 for the particular application. The compressor 128 can be a single-stage, two-stage, or variable capacity compressor. Alternatively, or in addition, the system 100 can include more than one compressor 128.

The condenser 122 can be sized, shaped, and installed in a position that improves energy transfer to the water in the heating chamber 102. For example, the condenser 122 can be sized and positioned near the bottom, middle, or top of the inside of the heating chamber 102 to ensure heat is transferred to the water in the heating chamber 102 efficiently as would be suitable for the particular application. On the other hand, the evaporator 126 can be located where it can absorb heat from the ambient air or other heat sources. The evaporator 126, for example, can be installed in an enclosure of the system 100 or in a separate location so long as the evaporator 126 is in fluid communication with other components of the HPPH 120. The evaporator can include any heat source, such as air, water, or geothermal sources. Both the condenser 122 and the evaporator 126 can be made of material(s) that can effectively exchange heat, including copper, aluminum, stainless steel, gold, silver, gallium, indium, thallium, graphite, composite materials, or any other material that is suitable for the particular application. Furthermore, the HPPH 120 can include more than one evaporator 126 and more than one condenser 122 to help increase heat transfer as would be suitable for the particular application.

The expansion valve 124 can be any type of expansion valve. For example, the expansion valve 124 can be a thermal expansion valve, a manual expansion valve, an automatic expansion valve, an electronic expansion valve, a low-pressure float valve, a high-pressure float valve, capillary tubes, or any other form of expansion valve appropriate for the application. The size, type, and installed location of the expansion valve 124 can vary depending on the application, which can be influenced by the specific system requirements or other considerations.

The system 100 can include a current sensor 129 configured to detect and measure the amperage (or current flow) of an electrical current delivered to components of the system 100. For example, the current sensor 129 can be configured to detect a current delivered to at least the compressor 128. The current sensor 129 can be or include any type of current sensing device including both direct and indirect current measuring devices. For example, the current sensor 129 can be or include a shunt resistor device where the current is determined by measuring a voltage drop across the shunt resistor. Alternatively or in addition, the current sensor 129 can be or include a current transformer, Rogowski coil, Hall effect sensor, Fluxgate sensor, magneto-resistive current sensor, or any other suitable type of current sensor for the application. As will be appreciated, the controller 160 can be in communication with the current sensor 129 and determine the amount of current detected by the current sensor 129. As will be described in greater detail herein, the controller 160 can be configured to determine, based at least in part on the data received from the current sensor 129, whether to operate the HPPH 120 or the electric water heater 130. Furthermore, the controller 160 can be configured to determine a performance of the HPPH 120 based on the data received from the current sensor 129 and determine actions based on the determined performance of the HPPH 120.

The system 100 can include one or more refrigerant sensors 125 (e.g., a refrigerant temperature sensor and/or a refrigerant pressure sensor) that can be configured to detect a temperature and/or a pressure of refrigerant circulating through the HPPH 120. The refrigerant sensor 125 can be installed in any location in the HPPH 120 so long as the refrigerant sensor 125 is capable of detecting a temperature and/or pressure of the refrigerant in the HPPH 120. As will be described in greater detail herein, the controller 160 can be configured to receive temperature and/or pressure data of the refrigerant from the refrigerant sensor 125 to determine a heat output of the HPPH 120. For example, the refrigerant sensor 125 can be configured to detect a temperature and/or pressure of the refrigerant in the HPPH 120 that is indicative of the superheat of the refrigerant. The controller 160 can then determine, using the temperature and/or pressure data from the refrigerant sensor 125, the heat output of the HPPH 120 and, in turn, a current performance of the HPPH 120.

As mentioned briefly, the system 100 can include various supplemental heat sources such as an electric water heater 130, a gas water heater, and/or a solar thermal water heater 150. As will be described in greater detail herein, the supplemental heat sources can be used to provide additional heat to the pool water when the controller 160 determines that the HPPH 120 is unable to meet the current heat demand or would not be the most efficient heat source under the current conditions.

The electric water heater 130 can be located anywhere in the system 100 where the electric water heater 130 can provide heat to the fluid in the system 100. For example, the electric water heater 130 can be located upstream of the heating chamber 102, inside of the heating chamber 102, or downstream of the heating chamber 102. The electric water heater 130 can be configured to be controlled by the controller 160 based on a control signal output by the controller 160. Furthermore, the electric water heater 130 can be modulated by the controller 160 to vary the output of the electric water heater 130. For example, the controller 160 can output a control signal to modulate the electric water heater 130 to operate at anywhere between 0% to 100% of the electric heating element's 130 heat output capacity.

The electric water heater 130 can include any form of resistive heating element suitable for the application. For example, the electric water heater 130 can be made with a Nichrome (NiCr) resistive element surrounded by an insulating material and encased in a casing. The resistive element can be made from Nichrome, Kanthal™, Constantan, Manganin™, Balco™ or any other suitable material. The insulating material can be made from insulating material such as Magnesium Oxide, glass, porcelain, composite polymer materials, clay, quarts, alumina, feldspar, or any other suitable insulating material. The casing can be made from a metal (e.g., titanium, stainless steel, nichrome, Kanthal™, cupronickel, etched foil, and the like.), a ceramic (e.g., molybdenum disilicide, silicon carbide, PTC ceramic, and the like.), thick film, or a polymer PTC heating element. Furthermore, the casing can be treated or coated to help prevent corrosion and elongate the life of the element. For example, the system 100 can include an electric water heater 130 with a heating element having a casing made of copper and treated with a nickel plating. Alternatively or in addition, the electric water heater 130 can include a heating element having a copper tubing casing coated with magnesium oxide and zinc plating. Alternatively or in addition, the electric water heater 130 can include a heating element having a titanium or stainless-steel casing that is coated with an appropriate coating, if desired. One of skill in the art will appreciate that the exact materials and configuration of the electric water heater 130 can vary depending on the particular application.

The system 100 can include a gas water heater 140 that can be configured to heat the water as it passes through the heating chamber 102. Alternatively, the gas water heater 140 may have its own heating chamber, such as a heat exchanger, and be located upstream, downstream, or altogether separate from the heating chamber 102 so long as the gas water heater 140 is capable of providing heat to the water in the pool 101. The gas water heater 140 can be any type of gas water heater suitable for the application. For example, the gas water heater 140 can be configured to consume natural gas, propane, butane, or any other suitable type of flammable gas for the application. Furthermore, although described as a gas water heater 140, the gas water heater 140 can be configured to consume matter other than flammable gasses. For example, the gas water heater 140 can be configured to consume wood, wood pellets, coal, liquid gas, oil, or any other flammable matter that can be used to create combustion gasses to heat the pool water.

The system 100 can include a solar thermal water heater 150 that can be configured to utilize solar energy to heat the pool water. The solar thermal water heater 150 can be configured to heat the pool water as sunlight strikes an absorber surface, by which heat can be generated. The absorber surface can be part of a solar thermal collector such as a flat plate collector, an evacuated tube collector, a hydronic coil, or any other suitable form of solar thermal collector for the application. Moreover, the solar thermal water heater 150 can be any form of solar thermal system as would be suitable for the particular application. For example, the solar thermal water heater 150 can be a closed-loop or an open-loop system and it can be either actively or passively circulated. If actively circulated, for example, the solar thermal water heater 150 can include a pump to circulate the water (or heat transfer fluid) through the solar thermal water heater 150. If the solar thermal water heater 150 is a closed-loop system, it can use a heat exchanger with any appropriate heat transfer fluid to transfer heat to the pool water. The heat transfer fluid can be, for example, distilled water, propylene glycol, ethylene glycol, triethylene glycol, glycol-water mix, alcohol-water mix, mineral oil, or any other heat transfer fluid appropriate for the application. Alternatively, if the solar thermal water heater 150 is an open-loop system, the solar thermal water heater 150 can include an inlet 152 and an outlet 154 that can circulate water between the heating chamber 102 or directly to the pool 101 and the water can be heated directly by the solar thermal collector. The water can be circulated between the solar thermal water heater 150 and the heating chamber 102 or between the solar thermal water heater 150 and the pool 101.

The controller 160 can have a memory 162, a processor 164, and a communication interface 166. The controller 160 can be a computing device configured to receive data, determine actions based on the received data, and output a control signal instructing one or more components of the system 100 to perform one or more actions. One of skill in the art will appreciate that the controller 160 can be installed in any location, provided the controller 160 is in communication with at least some of the components of the system. Furthermore, the controller 160 can be configured to send and receive wireless or wired signals and the signals can be analog or digital signals. The wireless signals can include Bluetooth™, BLE, WiFi™, ZigBee™, infrared, microwave radio, or any other type of wireless communication as may be suitable for the particular application. The hard-wired signal can include any directly wired connection between the controller and the other components. For example and not limitation, the controller 160 can have a hard-wired 24 VDC connection to the water temperature sensor 108. Alternatively, the components can be powered directly from a power source and receive control instructions from the controller 160 via a digital connection. The digital connection can include a connection such as an Ethernet or a serial connection and can utilize any suitable communication protocol for the application such as Modbus, fieldbus, PROFIBUS, SafetyBus p, Ethernet/IP, or any other suitable communication protocol for the application. Furthermore, the controller 160 can utilize a combination of wireless, hard-wired, and analog or digital communication signals to communicate with and control the various components. One of skill in the art will appreciate that the above configurations are given merely as non-limiting examples and the actual configuration can vary depending on the particular application.

The controller 160 can include a memory 162 that can store a program and/or instructions associated with the functions and methods described herein and can include one or more processors 164 configured to execute the program and/or instructions. The memory 162 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and/or other applications, as necessary), executable instructions and data. One, some, or all of the processing techniques or methods described herein can be implemented as a combination of executable instructions and data within the memory.

The controller 160 can also have a communication interface 166 for sending and receiving communication signals between the various components. Communication interface 166 can include hardware, firmware, and/or software that allows the processor(s) 164 to communicate with the other components via wired or wireless networks, whether local or wide area, private or public, as known in the art. Communication interface 166 can also provide access to a cellular network, the Internet, a local area network, or another wide-area network as suitable for the particular application.

Additionally, the controller 160 can have or be in communication with a user interface 168 for displaying system information and receiving inputs from a user. The user, for example, can view system data on the user interface 168 and input data or commands to the controller 160 via the user interface 168. For example, the user can view threshold settings on the user interface 168 and provide inputs to the controller 160 via the user interface 168 to change a threshold setting. The user interface 168 can be installed locally on the system 100 or be a remotely controlled device such as a mobile device. If the user interface 168 is a mobile device, the user interface 168, for example, can be a smart phone, a tablet, a laptop, a remote control unit, or any other device that can be in remote communication with the controller 160.

The controller 160 can be in communication with a remote server 170 via the communication interface 166. The remote server 170, for example, can be a single cloud computing device or group of cloud computing device that the controller 160 can be connected to via the internet. The remote server 170 can receive and store data supplied to the remote server 170 from the controller 160. For example, the controller 160 can supply historical operational data, temperature and humidity data detected by the sensor (e.g., water temperature sensor 108, air temperature sensor 110, humidity sensor 111, etc.), installation date (e.g., date of installation, components installed, etc.), maintenance data or any other data that can indicate historical or operation data of the pool water heating system 100. Alternatively, or in addition, the remote server 170 can generally be the internet and the controller 160 can be configured to receive data from various sources on the internet. For example, the controller 160 can receive local weather data, including current weather data, daily weather data, and a forecast of the weather in the near future. As another example, the controller 160 can receive current price data related to the price of electrical power, fuel prices, water prices, or other data that the controller 160 can use to determine a cost of operating the pool water heating system 100.

Figure 2:
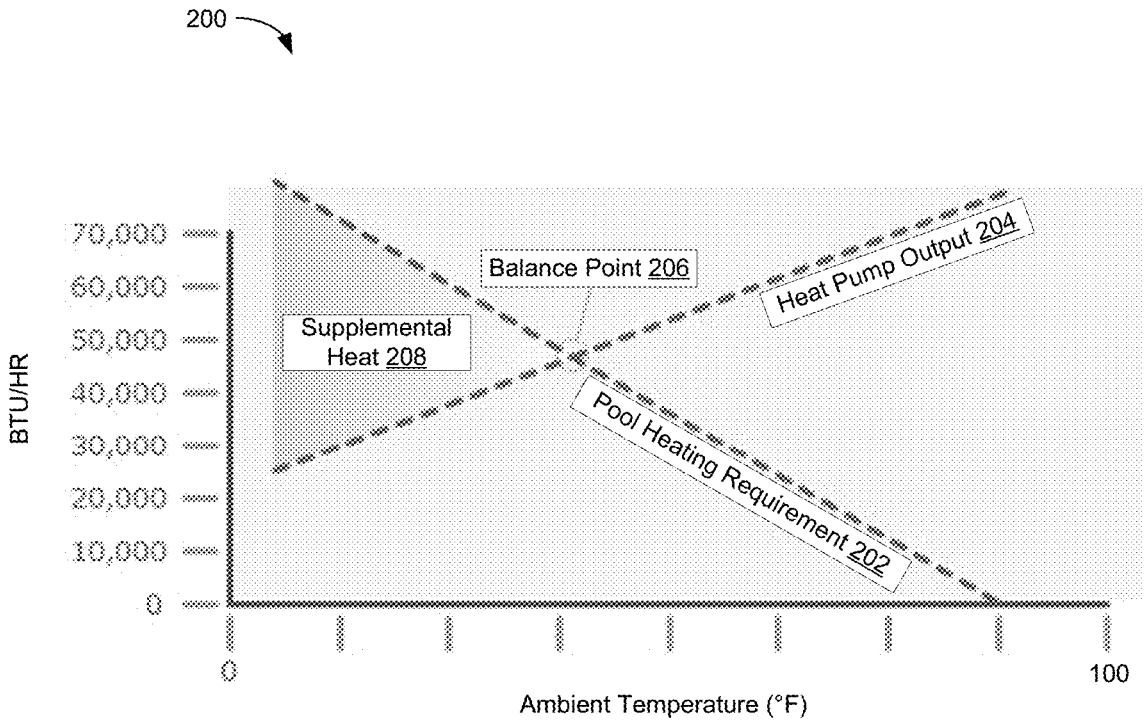
FIG. 2 is a graph illustrating a pool heating requirement and an example heat pump's output in relation to the pool heating requirement.

FIG. 2 is a graph 200 illustrating a pool heating requirement 202 and a heat pump's output 204 in relation to the pool heating requirement 202. The x-axis represents the ambient temperature while the y-axis represents an example heat output of the heat pump pool heater (e.g., HPPH 120). As will be appreciated by one of skill in the art, as the ambient temperature rises, the need for heating the pool decreases because less heat from the water is lost to the ambient air. As the ambient temperature rises, the need for heating the pool water can eventually be nonexistent as the water temperature can be maintained at a suitable temperature without needing to add heat to the water. Furthermore, as will be appreciated by one of skill in the art, as the ambient temperature rises, the heat pump is better able to heat the water because the ambient air has more heat available for the heat pump to transfer to the water. As the ambient temperature decreases, however, the output of the heat pump also decreases. Because the heat pump output 204 decreases with decreasing ambient temperature but the pool heating requirement increases with decreasing ambient temperature, the heat pump output 204 will eventually be unable to meet the pool heating requirement 202. The point where the heat pump output 204 matches the pool heating requirement 202 is known as the balance point 206. At ambient temperatures below the balance point 206, supplemental heat 208 (e.g., supplemental heat sources such as the electric water heater 130, the gas heater 140, and the solar thermal water heater 150) is required to meet the pool heating requirement 202. Furthermore, the heat pump output 204 may decrease if the heat pump begins to operate less efficiently for any reason (e.g., refrigerant leak, compressor malfunction, expansion valve malfunction, etc.) and the heat pump may eventually be unable to meet the pool heating requirement 202. Therefore, to ensure the heat pump is able to meet the pool heating requirement 202 and to ensure the water is heated as efficiently as possible, the pool water heating system 100 can be configured to determine the actual performance of the HPPH 120 and determine the most efficient heat source to utilize the heat the pool 101.

Figure 3:
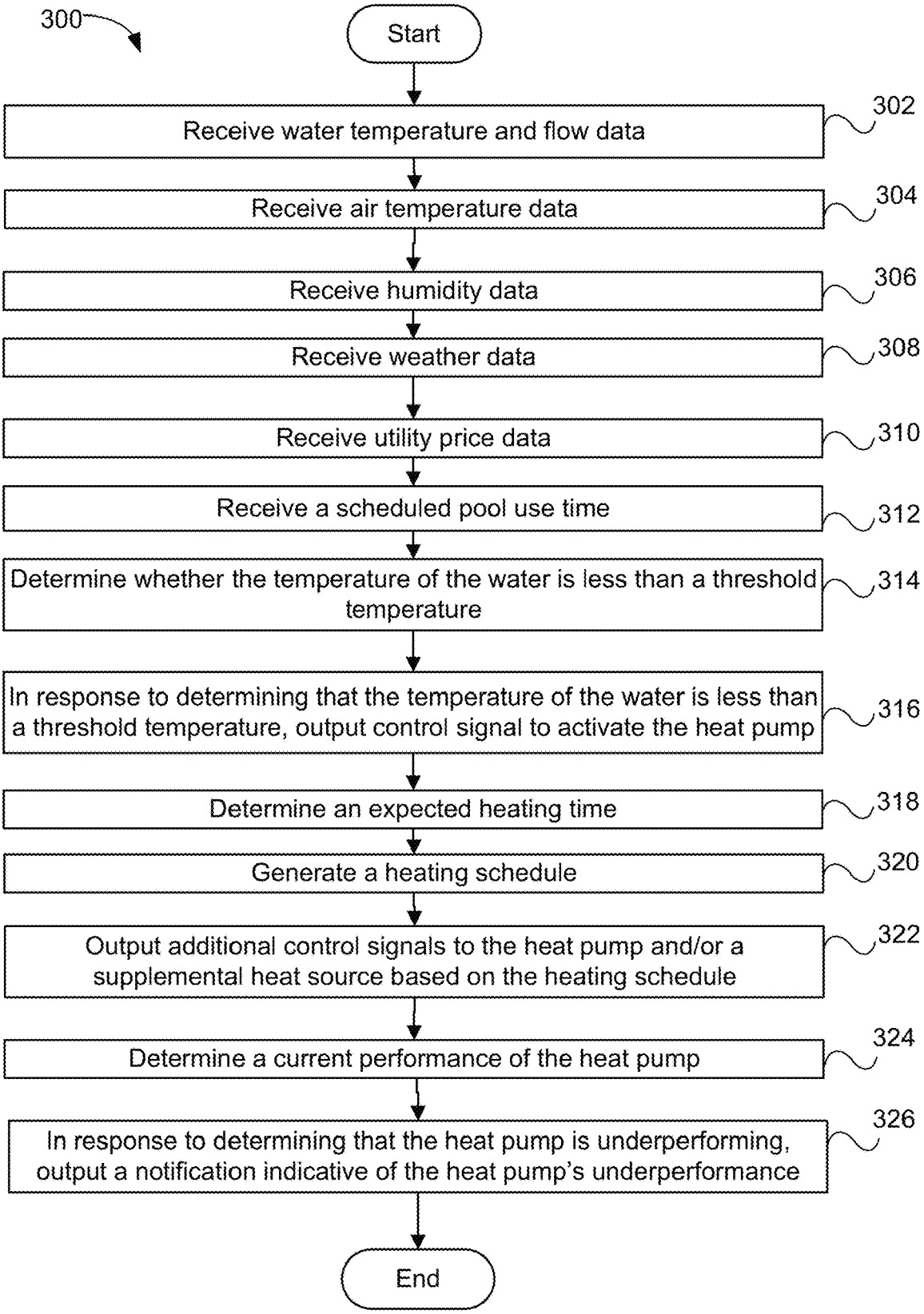
FIG. 3 is a flowchart illustrating a method of operating the pool water heating system, in accordance with the disclosed technology.

FIG. 3 is a flowchart illustrating a method 300 of operating the pool water heating system 100, in accordance with the disclosed technology. As will be appreciated by one of skill in the art, the method 300 can be implemented by the controller 160 by having instructions stored on the memory 162 that can be executed by one or more processors 164. Furthermore, the method 300 can include all or only some of the various actions described herein. Each action described herein can be executed in various orders and be executed only a single time or executed multiple times.

The method 300 can include receiving 302 water temperature and flow data (e.g., water temperature data from the water temperature sensor 108 and water flow data from the flow sensor 105), receiving 304 air temperature data (e.g., air temperature data from the air temperature sensor 110), and receiving 306 humidity data (e.g., humidity data from the humidity sensor 111). Alternatively or in addition the method 300 can include receiving 308 weather data. The weather data can be received from a remote server (e.g., remote server 170) and can include current weather data such as the temperature, humidity, cloud cover, sun position, precipitation data, wind direction and speed, etc. Alternatively, or in addition, the weather data can include forecast data indicative of forecasted future local weather conditions. For example, the weather data can include a two-week weather forecast for the local area. The method 300 can further include receiving 310 utility price data. The utility price data can include price data indicative of current prices of electricity, gas (e.g., natural gas, propane, butane, etc.), water, or other prices associated with various utilities that may be utilized by the pool water heating system 100. The method 300 can include receiving 312 a scheduled pool use time or use schedule (e.g., a predetermined time of use of the pool 101, user-inputted times of use of the pool). For example, a user of the pool water heating system 100 may have a specific time at which he or she would like the water in the pool 101 to be heated to a threshold temperature, and the scheduled pool use time can be indicative of the specific time the pool 101 is intended to be used. Receiving 312 the scheduled pool use time can include the user inputting the specific time into the user interface 168 and the controller 160 receiving the input from the user.

The method 300 can include determining 314 whether the current temperature of the water is less than a threshold temperature. In response to determining that the current temperature of the water is less than the threshold temperature, the method 300 can include outputting 316 a control signal to activate the heat pump (e.g., HPPH 120) to begin heating the pool water.

The method 300 can include determining 318 an expected heating time. The expected heating time can be indicative of the length of time the pool water heating system 100 required to bring the pool water temperature to a temperature equal to or greater than the threshold temperature. The expected heating time can be based, at least in part, on the water temperature data (e.g., the current water temperature or the water temperature over a length of time), the water flow data, the threshold temperature, and/or a heat output of the heat pump.

The heat output of the heat pump can be determined in several different ways. For example, the heat output of the heat pump can be an actual heat output of the heat pump or an expected heat output of the heat pump. The actual heat output of the heat pump can be determined by, for example, determining a rate of change of the temperature of the water in the pool over time by trending the water temperature over time based, at least in part, on the water temperature data. The actual heat output of the heat pump can also be determined by considering the flow rate of the water through the heating chamber. For example, the actual heat output of the heat pump can be calculated using the volumetric flow rate of the water passing through the heating chamber in combination with the temperature of the water being delivered to the pool. As will be appreciated by one of skill in the art, as the volumetric flow rate increases, the heat pump must output a greater amount of energy to heat the increasing volume of water to the same temperature. As another example, an actual heat output of the heat pump can be determined by comparing expected temperatures of water being delivered to the pool at specific volumetric flow rates with the actual temperature of the water being delivered to the pool at the given flow rate. A lower-than-expected water temperature at the given flow rate would be indicative of a degraded performance of the heat pump. The actual heat output of the heat pump can also be determined by temperature or pressure of the refrigerant in the HPPH 120 (e.g., by receiving temperature and/or pressure data from the refrigerant sensor 125 and determining a superheat of the HPPH 120).

The expected heat output of the HPPH 120 can be determined based on the type of compressor and refrigerant used in the HPPH 120. Alternatively, or in addition, the expected heat output of the HPPH 120 can be determined based on the weather data. For example, by knowing the temperature and humidity proximate the HPPH 120, an expected heat output of the HPPH 120 can be calculated. The expected heat output of the HPPH 120 can also be determined by receiving current data from the current sensor 129 and determining whether the HPPH 120 is drawing an expected current based on the heating conditions. For example, if the compressor 128 is drawing an expected current, the controller 160 can determine that the HPPH 120 is likely outputting an expected heat output for the type of HPPH 120 used in the system. On the other hand, if the compressor 128 is drawing a greater than expected current, the controller 160 can determine that the HPPH 120 is likely underperforming and the heat output is likely less than expected.

The method 300 can include generating 320 a heating schedule. Generating 320 the heating schedule can include determining, based on the expected heating time and the scheduled pool use time (e.g., a predetermined time of use of the pool 101), which heat source would be most efficient to operate at specific times to ensure the pool water is heated to a temperature greater than or equal to the threshold temperature. To determine which heat sources are available, for example, the controller 160 can receive data (heat pump data and supplemental heat source data) from each heat source indicative of the type of heat source available. If no scheduled pool use time has been received by the controller (e.g., the user did not specify a time for the pool 101 to be heated by), the controller 160 can assign a default scheduled pool use time. For example, the controller 160 can plan to have the pool water heated by three days from beginning heating. On the other hand, if the user has specified a time for the pool water to be heated, the controller 160 can determine most efficient method of heating the pool water based on the available heat source. As will be appreciated by one of skill in the art, if the scheduled pool use time is in the near future (e.g., a few hours), the HPPH 120 may be unable to meet the heat demand alone and additional heat sources may need to be operated to meet the heat demand. Furthermore, if the HPPH 120 is currently operating at a degraded performance, generating 320 the heating schedule can factor in the HPPH's 120 underperformance and schedule supplemental heat sources to heat the water. On the other hand, if the scheduled pool use time is in a more distant future (e.g., several days) the HPPH 120 may be able to meet the heat demand alone, however, the controller 160 may determine that is is more efficient to operate the solar thermal water heater 150 during times when the solar thermal water heater 150 is able to sufficiently generate heat (e.g., during times when sunlight is sufficient) and operate accordingly.

While the method above was described as outputting 316 instructions to operate the HPPH 120 prior to determining 318 the expected heating time, that is not necessarily the case. Alternatively, the method can include determining an expected heating time for two or more heat sources and then outputting instructions to operate at least one of the heat sources based on that determination. For example, the method 300 can include determining 318 an expected heating time for each available heat source (i.e., HPPH 120 and one or more supplemental heat sources (i.e., the electric water heater 130, the gas water heater system 140, and/or the solar thermal water heater 150)). The method 300 can include determining which heat source to activate based on the expected heating time and whether it is more important to heat the water efficiently or to ensure the water is heated to the threshold temperature at or before the scheduled pool use time. The controller 160 can be preset to default to heating the water using the most energy efficient method or by the scheduled pool use time depending on the particular application. Furthermore, a user may select which would be preferrable—heating the water using the most efficient method or heating the water to the threshold temperature by the scheduled pool use time.

Alternatively, or in addition, the controller 160 can be configured to determine whether to heat the water using the most energy efficient heat source available or to ensure that the water is heated to the threshold temperature by the scheduled pool use time based on an algorithm. For example, if the expected heat time is less than a first threshold heat time (i.e., the most energy efficient heat source available is able to sufficiently heat the water before the scheduled pool use time), the method 300 can include heating the water using the most energy efficient heat source available. Alternatively, if the expected heat time is greater than a second threshold heat time (i.e., it will take more time to heat the water to the threshold temperature using the most energy efficient heat source than is available before the scheduled pool use time), the method 300 can include heating the water using one or more faster heating options to ensure the water is heated to the threshold temperature by the scheduled pool use time. For example, if it is determined that the expected heat time is greater than the first threshold heat time, the method 300 can include outputting one or more control signals to the available heat sources to cause one or more heat sources to heat the water, despite the one or more heat sources not necessarily being the most energy efficient heat sources available. The first threshold heat time and the second threshold heat time can be the same or be different threshold heat times. Furthermore, the first threshold heat time and the second threshold heat time can be preset values or be user-configurable values.

Generating 320 the heating schedule can further include determining which heat source to operate based on the weather forecast. For example, if the scheduled pool use time is in a few days and the weather has varying conditions between beginning the heating period and the scheduled pool use time, the controller 160 can factor in the change in weather to determine the most energy efficient heat sources to use to heat the water in the pool 101. To illustrate, if the scheduled pool use time is in three days and the weather has temperature variations between 95° F. during the day and 65° F. at night, the controller 160 might determine that the HPPH 120 should be operated in the mornings and evenings, that solar thermal water heater 150 should be operated during the afternoons, and that the gas water heater 140 should be operated during the cool night hours to most efficiently heat the water. The controller 160 can therefore generate 320 a heating schedule accordingly. As will be appreciated, additional weather variations such as rain, wind, cloud cover, and/or humidity can also be considered by the controller 160 to generate 320 the heating schedule.

The controller 160 can be further configured to periodically, or continuously, check the temperature of the water and adjust the heating schedule based on the present temperature of the water. For example, if the temperature of the pool water is rising more slowly than expected, the controller 160 can update the heating schedule to ensure the pool water is sufficiently heated by the scheduled pool use time by scheduling additional supplemental heat sources to be operated. On the other hand, if the temperature of the pool water is rising faster than expected, the controller 160 can determine which other heating sourced may be more energy efficient to operate. As will be appreciated, the controller 160 can periodically, or continuously, adjust the heating schedule to ensure the pool water is sufficiently, and efficiently, heated by the scheduled pool use time.

To generate 320 the heating schedule, for example, the controller 160 can assign time and duration values to each available heating source to cause the heating source to begin heating at the assigned time and for the assigned duration. The assigned time can be a time of day that the heating source should begin heating and the duration can be a length of time for which the heating source should operate. For example, if the HPPH 120 is able to sufficiently meet the heat demand alone, the controller 160 can assign an immediate start time and the full duration of the expected heating time to the HPPH 120 and a value time and duration value of zero to the other supplemental heat sources (e.g., the electric water heater 130, the gas water heater 140, and the solar thermal water heater 150). Alternatively, if the HPPH 120 should only be operated for a part of the expected heating time, the controller 160 can assign individual start times and individual durations to the HPPH 120 and one or all of the supplemental heat sources depending on the scenario. The start times and durations may overlap, for example, if multiple heating sources are needed to sufficiently heat the water in the pool 101. As will be appreciated by one of skill in the art, the controller 160 can be configured to assign start times and durations to generate the heating schedule to ensure the water in the pool 101 is sufficiently heated by the scheduled pool use time and considering the various weather conditions and heat sources available.

The method 300 can further include outputting 322 additional control signals to the heat pump and/or a supplemental heat source based on the heating schedule. For example, in the previous example, the controller 160 can output a control signal to activate and/or deactivate the HPPH 120, the gas water heater 140, and the solar thermal water heater 150 based on when each heat source is scheduled to be operated.

The method 300 can further include determining 324 a current performance of the HPPH 120. Determining 324 a current performance of the HPPH 120 can include comparing an expected heat pump performance to an actual heat pump performance. The expected heat pump performance and the actual heat pump performance can be determined using any of the above-described methods. If, for example, the actual performance of the HPPH 120 is within an acceptable performance range of the expected performance, the controller 160 can determine that the heating schedule should be executed as scheduled. If, however, the actual performance of the HPPH 120 is outside of an acceptable performance range (e.g., underperforming more than an acceptable level), the controller 160 can once again determine 318 the expected heating time based on the actual heat pump performance. The controller 160 can generate a new heating schedule based on the actual performance of the pump to ensure the water in the pool is sufficiently heated by the scheduled pool use time.

In response to determining 326 that the heat pump is underperforming beyond an acceptable level, the method 300 can include outputting a notification indicative of the heat pump's (e.g., HPPH 120) underperformance. The notification can include a message sent to the user interface 168, a message sent to a user's mobile device, an email sent to a user's email account, or even a notification sent to a predetermined maintenance company. Furthermore, outputting 326 a notification can include scheduling maintenance with the predetermined maintenance company so that the HPPH 120 can be scheduled for repair and/or maintenance.

As will be appreciated, the method 300 just described can be varied in accordance with the various elements and examples described herein. That is, methods in accordance with the disclosed technology can include all or some of the steps described above and/or can include additional steps not expressly disclosed above. Further, methods in accordance with the disclosed technology can include some, but not all, of a particular step described above. Further still, various methods described herein can be combined in full or in part.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. A pool water heating system comprising:

a heat pump configured to provide heat to a volume of water;

a supplemental heat source configured to provide heat to the volume of water;

a flow sensor configured to determine a flow rate associated with the volume of water and output flow data indicative of the flow rate associated with the volume of water;

a water temperature sensor configured to detect a temperature of the volume of water and output water temperature data indicative of the temperature of the volume of water;

an air temperature sensor configured to detect a temperature of the ambient air proximate the heat pump and output air temperature data; and a controller configured to:

receive the flow data from the flow sensor;

receive the water temperature data from the water temperature sensor;

receive the air temperature data from the air temperature sensor;

in response to determining, based at least in part on the water temperature data, that the temperature of the volume of water is less than a threshold temperature, output a first control signal to activate the heat pump to heat the volume of water;

determine an expected heating time based at least in part on a heat output of the heat pump, the flow data, the water temperature data, and the threshold temperature, the expected heating time being indicative of an amount of time required for the heat pump to increase the temperature of the volume of water to a temperature greater than or equal to the threshold temperature;

generate a heating schedule based at least in part on the expected heating time and a predetermined time of use, the heating schedule being indicative of a heat pump operation time and a supplemental heat source operation time; and in response to determining, based at least in part on the air temperature data or the flow data, that the temperature of the ambient air proximate the heat pump is less than a threshold ambient temperature or that the flow rate associated with the volume of water is less than a threshold flow rate, output at least one of a second control signal to deactivate the heat pump or a third control signal to activate the supplemental heat source to heat the volume of water.

2. The pool water heating system of claim 1, wherein:

the controller is further configured to:

receive, from a remote server, weather data indicative of a forecast of local weather, and determining the expected heating time is further based at least in part on the weather data.

3. The pool water heating system of claim 2, wherein:

generating the heating schedule comprises:

determining the heat pump operation time and the supplemental heat source operation time based at least in part on the expected heating time, the weather data, and supplemental heat source data, the supplemental heat source data being indicative of a type of supplemental heat source available, and wherein the heat pump operation time comprises a scheduled time to operate the heat pump and the supplemental heat source operation time comprises a scheduled time to operate the supplemental heat source, and the controller is further configured to:

receive, from a user interface, instructions to override the second control signal or the third control signal.

4. The pool water heating system of claim 3, wherein the supplemental heat source comprises a gas water heater.

5. The pool water heating system of claim 3, wherein the supplemental heat source comprises an electric water heater.

6. The pool water heating system of claim 3, wherein the supplemental heat source comprises a solar thermal water heater.

7. The pool water heating system of claim 1, wherein the controller is further configured to:

calculate the heat output of the heat pump based at least in part on heat pump data, the heat pump data being indicative of at least a type of compressor and a type of refrigerant of the heat pump.

8. The pool water heating system of claim 1, wherein the controller is configured to:

receive, from a remote server, weather data indicative of a forecast of local weather; and calculate, based at least in part on the weather data, the heat output of the heat pump.

9. The pool water heating system of claim 1 further comprising:

a humidity sensor configured to detect a humidity level of ambient air proximate the heat pump and output humidity data, wherein the controller is further configured to:

receive the humidity data from the humidity sensor; and calculate, further based at least in part on the humidity data, the heat output of the heat pump.

10. The pool water heating system of claim 1 further comprising:

a refrigerant temperature sensor configured to detect a refrigerant temperature of the heat pump and output refrigerant temperature data, wherein the controller is further configured to:

receive the refrigerant temperature data from the refrigerant temperature sensor; and calculate, based at least in part on the refrigerant temperature data, the heat output of the heat pump.

11. The pool water heating system of claim 1 further comprising:

a current sensor configured to detect an electrical current supplied to the heat pump and output current sensor data, wherein the controller is further configured to:

receive the current sensor data from the current sensor; and calculate, based at least in part on the current sensor data, the heat output of the heat pump.

12. The pool water heating system of claim 1, wherein the controller is further configured to:

calculate, based at least in part on the water temperature data over a period of time, a current heat output of the heat pump.

13. The pool water heating system of claim 12, wherein the controller is further configured to:

determine, based at least in part on a type of compressor of the heat pump, an expected heat output of the heat pump, and in response to determining that the current heat output of the heat pump is less than the expected heat output of the heat pump, output a notification to a user interface, the notification being indicative of the heat pump operating at a degraded performance.

14. The pool water heating system of claim 13, wherein the controller is further configured to:

in response to determining that the current heat output of the heat pump is less than the expected heat output of the heat pump, output, to a remote server, a request to schedule maintenance for the heat pump.

15. The pool water heating system of claim 1, wherein the predetermined time of use is received from a user interface in communication with the controller.

16. The pool water heating system of claim 15, wherein the user interface is a mobile device.

* * * * *